US006611665B2

(12) United States Patent
DiRubio et al.

(10) Patent No.: US 6,611,665 B2
(45) Date of Patent: Aug. 26, 2003

(54) METHOD AND APPARATUS USING A BIASED TRANSFER ROLL AS A DYNAMIC ELECTROSTATIC VOLTMETER FOR SYSTEM DIAGNOSTICS AND CLOSED LOOP PROCESS CONTROLS

(75) Inventors: Christopher A. DiRubio, Webster, NY (US); Charles A. Radulski, Macedon, NY (US); Alexander J. Fioravanti, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 63 days.

(21) Appl. No.: 10/052,644

(22) Filed: Jan. 18, 2002

(65) Prior Publication Data

US 2003/0138257 A1 Jul. 24, 2003

(51) Int. Cl.[7] ..... G03G 15/00; G03G 15/66
(52) U.S. Cl. ..... 399/9; 399/66
(58) Field of Search ..... 399/9, 66, 313

(56) References Cited

U.S. PATENT DOCUMENTS 3,781,105 A 12/1973 Meagher ..... 355/3
5,196,885 A * 3/1993 Takeuchi et al. ..... 399/66 X
5,420,677 A 5/1995 Gross et al. ..... 355/277
5,881,347 A 3/1999 May et al. ..... 399/302
5,887,220 A 3/1999 Nagaoka ..... 399/46
5,915,145 A * 6/1999 Shimura et al. ..... 399/66
5,966,561 A * 10/1999 Yamaguchi ..... 399/66
5,970,297 A 10/1999 Gross ..... 399/313
6,026,257 A * 2/2000 Takami et al. ..... 399/66
6,055,389 A * 4/2000 Takahashi ..... 399/66
6,058,275 A * 5/2000 Kodama ..... 399/66 X
6,205,299 B1 * 3/2001 Kusaka et al. ..... 399/66 X
6,219,075 B1 4/2001 Hammond et al. ..... 347/130
6,242,144 B1 6/2001 Lin et al. ..... 430/58.4
6,404,998 B1 * 6/2002 Tanaka et al. ..... 399/66

* cited by examiner

*Primary Examiner*—Fred L Braun
(74) *Attorney, Agent, or Firm*—Perman & Green, LLP

(57) ABSTRACT

A system and method for controlling a xerographic printer includes a subsystem for carrying out a function of the xerographic printer and affecting an electric field of a component. The system and method further include a bias transfer roll voltage operated in a constant current mode, and a voltage evaluator coupled to the biased transfer roll for measuring a change in a level of voltage of the bias transfer roll as the component affected by the subsystem passes through a nip region near the bias transfer roll for determining operability of the subsystem.

20 Claims, 7 Drawing Sheets

FIG. 5
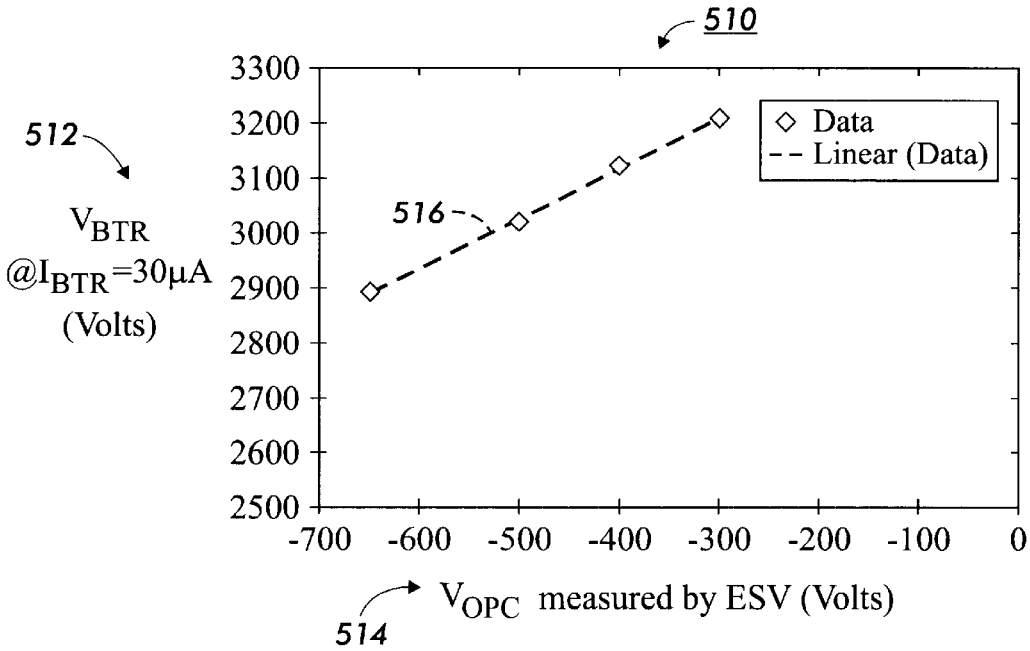
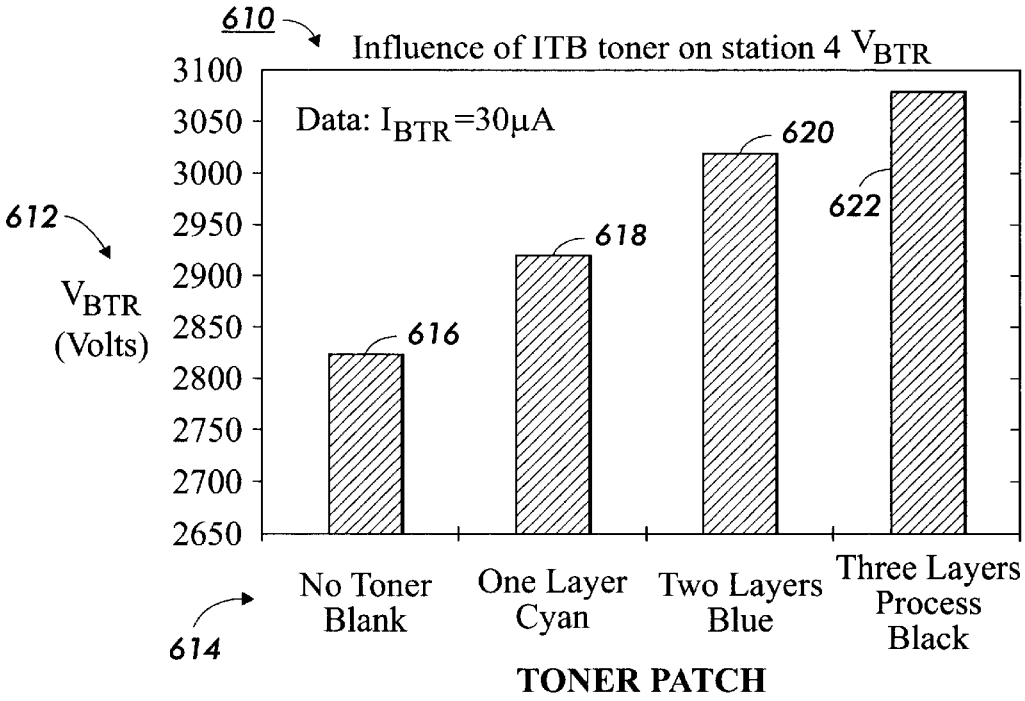
FIG. 6

METHOD AND APPARATUS USING A BIASED TRANSFER ROLL AS A DYNAMIC ELECTROSTATIC VOLTMETER FOR SYSTEM DIAGNOSTICS AND CLOSED LOOP PROCESS CONTROLS

BACKGROUND OF THE INVENTION

1. Field of the Invention

The present invention relates to control of xerographic printers and, more particularly, for diagnostic and closed loop process control of xerographic printers.

2. Brief Description of Related Developments

Xerographic printers, such as copiers or laser printers, use an electrostatic voltmeter as a powerful tool for monitoring system and component performance. Voltage measurements obtained with an electrostatic voltmeter can be used to evaluate system performance and diagnose system and subsystem failures. Electrostatic voltmeters are also used for closed loop system and subsystem control.

Electrostatic voltmeters are useful but add cost and complexity to xerographic printers. While the inclusion of electrostatic voltmeters in all xerographic printers would allow for improved printer performance and improved maintenance, the additional unit manufacturing cost and the reduction in available space around the photoreceptor precludes the use of electrostatic voltmeters in low and medium volume xerographic printers.

SUMMARY OF THE INVENTION

The disclosed embodiments are directed to a system for controlling a xerographic printer. In one embodiment the system includes a subsystem for carrying out a function of the xerographic printer and affecting an electric field generated by a component. The system further includes a bias transfer roll operated in a constant current mode. A voltage evaluator is coupled to the biased transfer roll for measuring a change in a level of voltage of the bias transfer roll as the component affected by the subsystem passes through a nip region near the bias transfer roll. This change in the voltage level determines operability of the subsystem. Further embodiments are directed to a method for controlling a xerographic printer. In one embodiment the method includes the step of maintaining a biased transfer roll in a constant current mode. The method further includes measuring a change in a level of voltage of the bias transfer roll as a component affected by a subsystem passes through a nip region near the bias transfer roll. This change in the voltage level determines operability of the subsystem.

BRIEF DESCRIPTION OF THE DRAWINGS

The foregoing aspects and other features of the present invention are explained in the following description, taken in connection with the accompanying drawings, wherein:

FIG. 5 is a chart showing one embodiment of the present invention illustrating a use of the biased transfer roll for measuring a photoreceptor subsystem incorporating features of the present invention.

FIG. 6 is bar graph showing one embodiment of the present invention illustrating a use of the biased transfer roll for measuring toner pile height.

DETAILED DESCRIPTION OF THE PREFERRED EMBODIMENT

Figure 1:
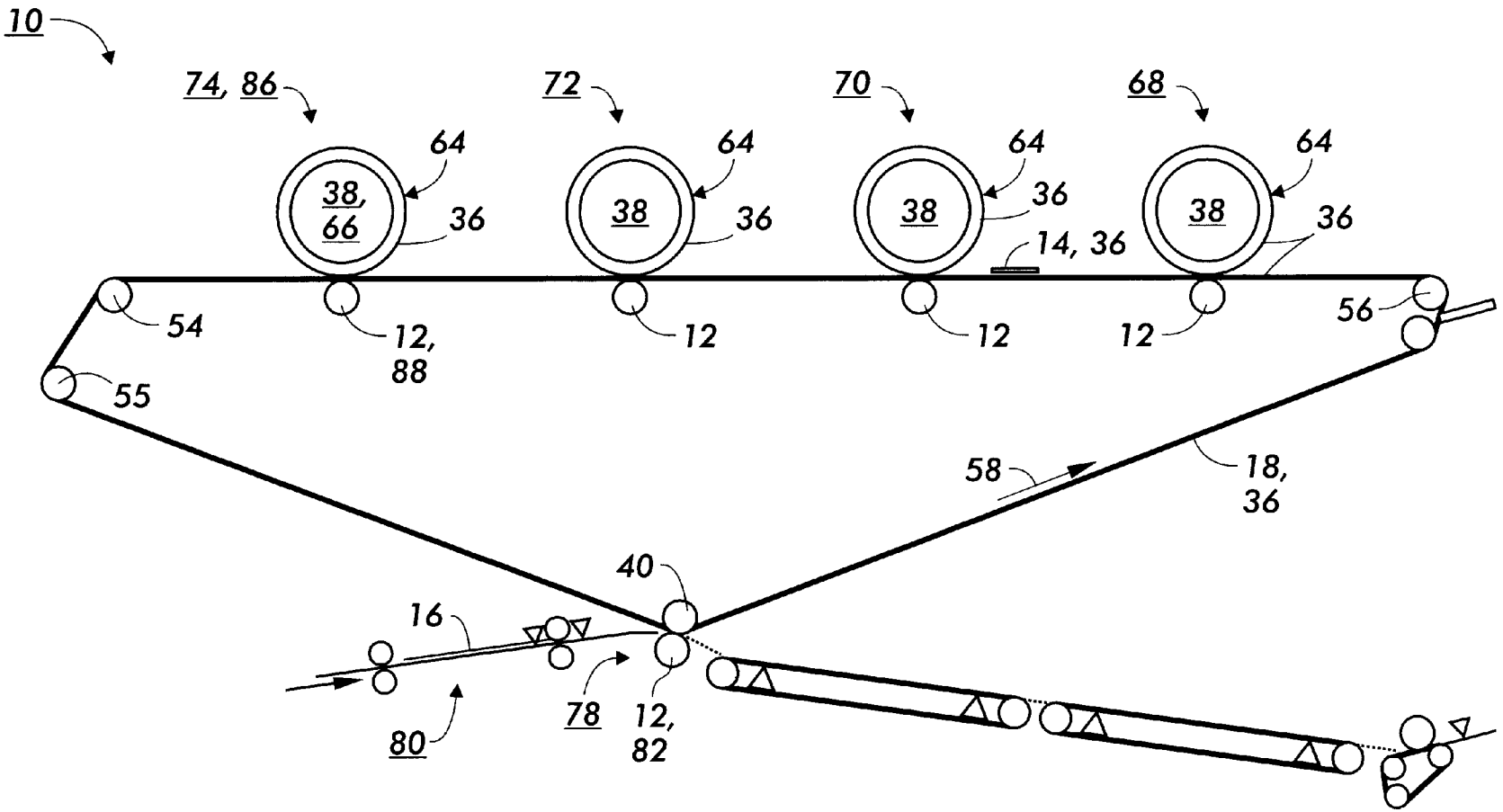
FIG. 1 is a schematic of a xerographic printer implementing one embodiment of a biased transfer roll incorporating features of the present invention.

Referring to FIG. 1, there is shown a schematic view of a xerographic printer 10, such as a copier or laser printer, incorporating features of the present invention. Although the present invention will be described with reference to the embodiment shown in the drawings, it should be understood that the present invention can be embodied in many alternate forms of embodiments. In addition, any suitable size, shape or type of elements or materials could be used.

As shown in FIG. 1, the xerographic printer 10 generally includes at least one biased transfer roll 12 as a feature of the disclosed embodiment. Many xerographic printers 10 (such as the following xerographic systems owned by the Xerox Corporation: DocuColor™4, DocuColor™12, Phaser™7700, DocuColor™2060, Document Center™220, etc.) use at least one biased transfer roll 12 for transferring imaged toner 14 to a sheet-type substrate 16 or an intermediate transfer belt 18. While transferring imaged toner 14 to a sheet type substrate has been shown and described, the present invention is not so limited, as biased transfer rolls can also be used to transfer to continuous rolls of paper, without departing from the broader aspects of the present invention. Some high volume xerographic printers 10 may have five or more bias transfer rolls 12, while many low volume xerographic printers 10 have at least one biased transfer roll 12.

U.S. Pat. No. 3,781,105 discloses some examples of a biased transfer roll used in a xerographic printer, the disclosure of which is hereby incorporated by reference. Some of the details disclosed therein may be of interest as to teachings of alternatives to details of the embodiment herein.

In the present embodiment, the biased transfer roll 12 also functions as a sensor, and can be used to replace or supplement the usefulness of existing sensors, such as an electrostatic voltmeter. Furthermore, the biased transfer roll 12 already exists on many xerographic printers, and the biased transfer roll 12 can function as a sensor without modifying the existing transfer hardware of the bias transfer roll 12. The biased transfer roll 12 provides measurements comparable to measurements taken with an electrostatic voltmeter without having to add an expensive and space consuming sensor, such as the electrostatic voltmeter. Many high volume xerographic printers 10 use at least one electrostatic voltmeter for diagnosing errors in xerographic printer systems 10 and subsystems 22. The following Xerox Corp. co-pending U.S. patent application discloses some examples of general xerographic copiers 10 and electrostatic voltmeters: Ser. No. 09/725,398, hereby incorporated by reference. Some of the details disclosed therein may be of interest as to teachings of alternatives to details of the embodiment herein.

Continuing with FIG. 1, each bias transfer roll 12 can be used to take measurements of different stages of the printing process, such as before and after the operation of each development subsystem 24. The use of a multiplicity of bias transfer rolls 12 as sensors also allows for measurements for diagnostic and system control which would be very difficult to obtain without adding additional dedicated sensors. Moreover, the use of the bias transfer roll 12 as a sensor can bring electrostatic voltmeter functionality to low volume xerographic printers that cannot afford the unit material cost of traditional electrostatic voltmeters.

Figure 2:
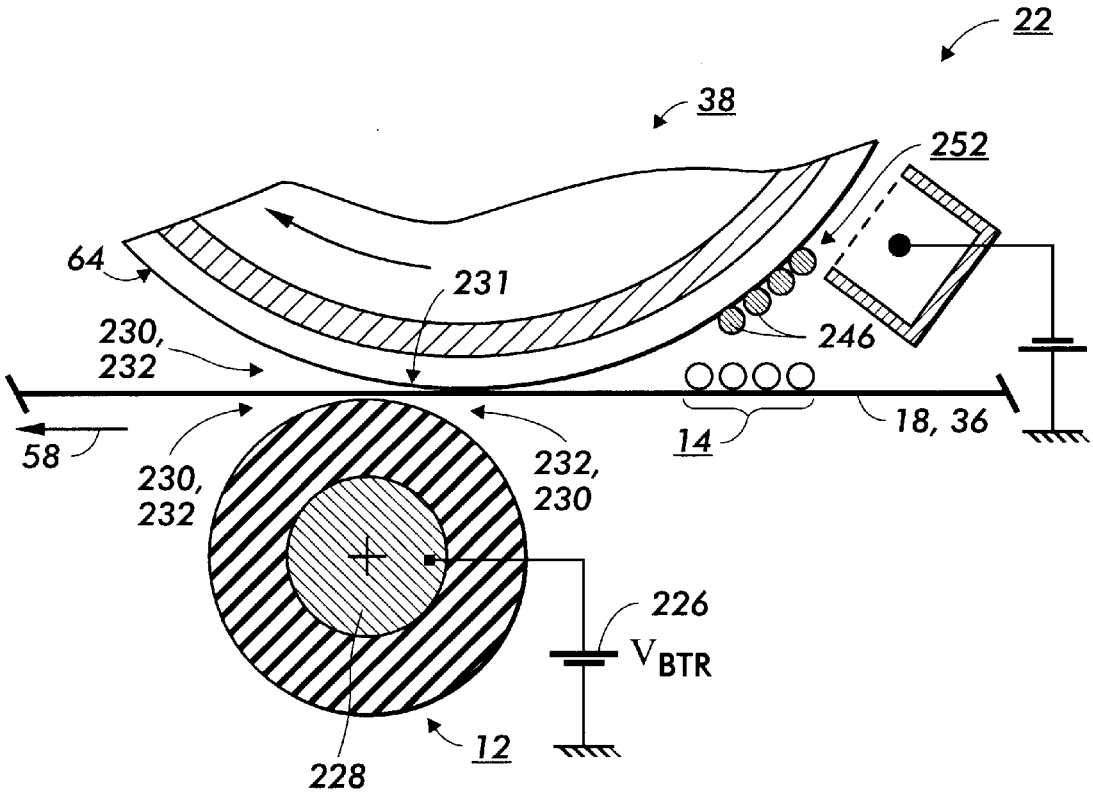
FIG. 2 is a schematic of one embodiment of the present invention using a biased transfer roll as a sensor.

Referring to FIG. 2, the biased transfer roll 12 is generally operated in a constant current mode, in which a high voltage power supply 226 varies a voltage ($V_{BTR}$) applied to a steel shaft 228 of the biased transfer roll 12 to maintain a constant current. In one embodiment, changes in the level of voltage of the biased transfer roll 12 can be used to indicate a change in the electric field in air gaps 230 leading to and from each nip 231, which is the contact or almost contact area having small or zero air gaps 230 between the biased transfer roll 12 and, for example, a photoconductor drum 38. A nip region 232 generally includes the nip 231 and the air gaps 230 upstream of the nip 231 (pre-nip region), and the air gaps 230 downstream of the nip 231 (post-nip region). The biased transfer roll 12 can function in a dynamic mode where the components 36, such as photoreceptor, belts and toner, are moving through the nip region 232.

Continuing with FIG. 2, the electric field of the biased transfer roll 12 in the nip region 232 can be affected by an electrical field generated by components 36 of the xerographic printer 10 passing through the nip region 232. The voltage ($V_{BTR}$) applied to the shaft 228 of the biased transfer roll 12 shifts in response to changes in the operating properties of subsystems 22, and the electrical field of the components 36 affected by the subsystems, which enter the air gaps 230. A subsystem 22 can affect a component 36 or a plurality of components, by altering the electrical field of the component 36 itself, by depositing to or removing a charge from the surface 64 of a component 36, or by depositing or removing another charged component 36 such as toner, to or from another component 36.

Still referring to FIG. 2, the biased transfer roll 12 can also be used to measure shifts in the electrical properties of the biased transfer roll 12 itself, the photoreceptor drum (OPC) 38, the intermediate transfer belt 18, and/or the sheet-type substrate 16, and any other material within the nip region 232, such as a back up roll (BUR) 40. The voltage of the biased transfer belt is particularly sensitive to shifts in the resistivity of any of these materials. $V_{BTR}$ is measured to determine changes in the properties of the subsystems 22 and the components 36. The biased transfer roll 12 can be used to evaluate the performance of systems 10, subsystems 22, and components 36.

The nip region 232 being monitored by the biased transfer roll 12 is not limited to the above described convergence of components 36, as the nip region 232 may be caused by the convergence of any component 36, such as the back up roll (BUR) 40, with the biased transfer roll 12, without departing from the broader aspects of the present invention.

Figure 1A:
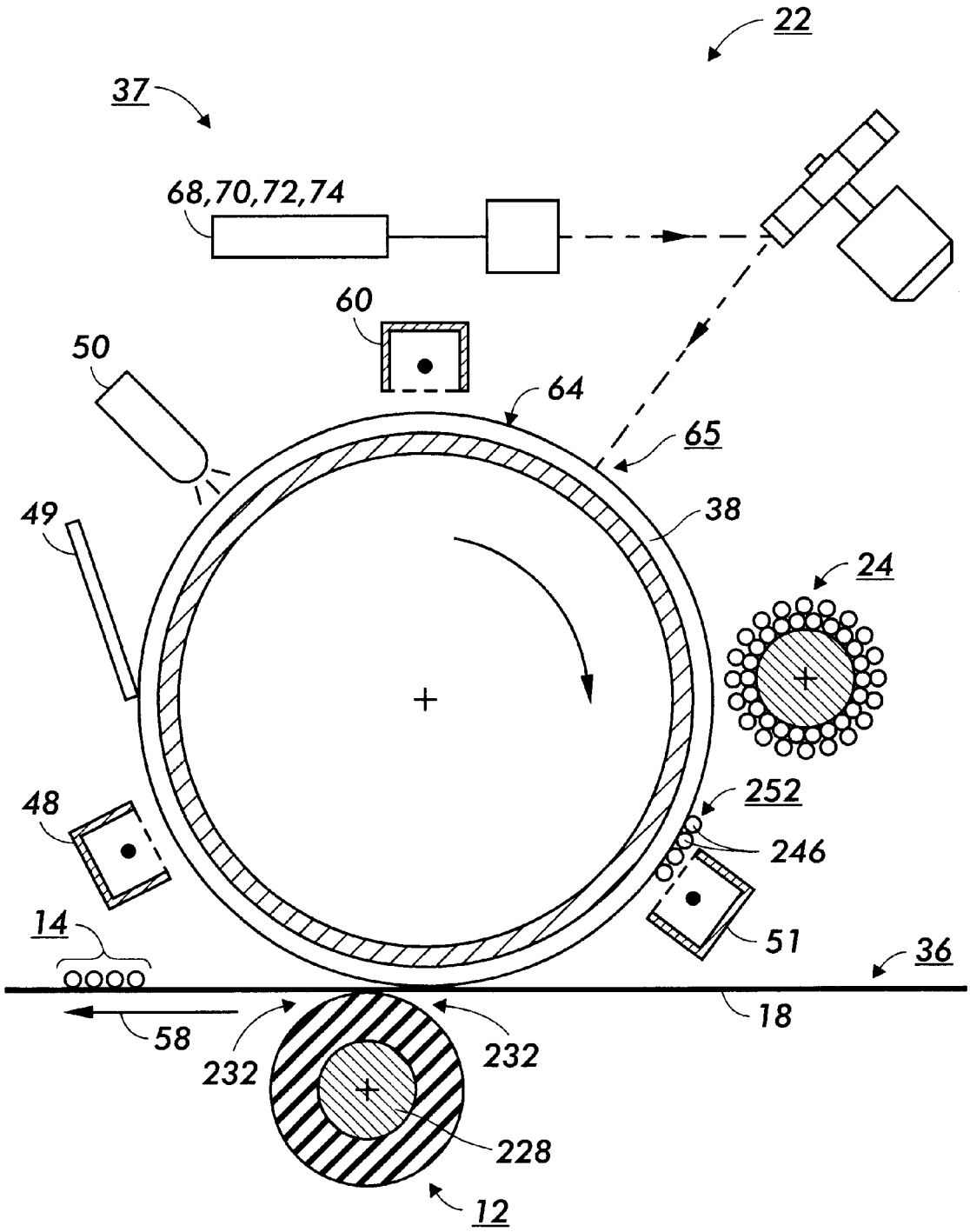
FIG. 1A is a schematic of one embodiment of a xerographic station incorporating features of the present invention.

Referring to FIG. 1A, before describing the particular features of the present invention in detail, an exemplary xerographic printer 10 will be described, which can be a black and white or multicolor copier or laser printer. To initiate the copying process, a multicolor original document is positioned on a raster input scanner (RIS) which captures the entire image from original document which is then transmitted to a raster output scanner (ROS) 37. The raster output scanner 37 illuminates a charged portion of a photoconductor 64 of a photoconductor drum (OPC) 38, or photoconductor drums 38, of a xerographic printer 10. While a photoconductor drum 38 has been shown and described, the present invention is not so limited, as the photoconductor surface 64 may be a type of belt or other structure, without departing from the broader aspects of the present invention. The raster output scanner 37 exposes each photoconductor drum 38 to record one of the four subtractive primary latent images.

Continuing with FIG. 1A, one latent image is to be developed 24 with a cyan developer material, which is a type of toner 246. Another latent image is to be developed 24 with magenta developer material, a third latent image is to be developed 24 with yellow developer material, and a fourth latent image is to be developed 24 with black developer material, each on their respective photoconductor drums 38. These developed images 252 are charged with a pre-transfer subsystem 51 and sequentially transferred to an intermediate belt 18, and subsequently transferred to a copy sheet 16 in superimposed registration with one another to form a multicolored image on the copy sheet which is then fused thereto to form a color copy. The photoconductor drum 38 is cleaned after the transfer with the use of a pre-clean subsystem 48, a clean subsystem 49 and a erase lamp 50.

Referring to FIG. 1, a xerographic printer 10 comprises an intermediate transfer belt 18 which is entrained about transfer rolls 12, tensioning rollers 54, steering roller 55, and drive roller 56. As drive roller 56 rotates, it advances the intermediate transfer belt 18 in the direction of arrow 58 to sequentially advance successive portions of the intermediate transfer belt 18 through the various processing stations disposed about the path of movement thereof. The intermediate transfer belt 18 usually advances continuously as the xerographic printer operates.

Referring to FIG. 1A, initially, a portion of each of the photoconductor drums 38 passes through a charging station 60. At the charging station 60, a corona generating device or other charging device generates a charge voltage to charge the photoconductive surface 64 of each photoconductor drum 38 to a relatively high, substantially uniform voltage potential ($V_{opc}$).

As shown in FIG. 1A, each charged photoconductor drum 38 is rotated to an exposure station 65. Each exposure station 65 receives a modulated light beam corresponding to information derived by raster input scanner having a multicolored original document positioned thereat. Alternatively, in a laser printing application the exposure may be determined by the content of a digital document. The modulated light beam impinges on the surface 64 of each photoconductor drum 38, selectively illuminating the charged surface 64 to form an electrostatic latent image thereon. The photoconductive surface 64 of each photoconductor drum 38 records one of three latent images representing each color. The fourth photoconductive drum 66 is used for either color or black and white documents.

Continuing to refer to FIG. 1A, after the electrostatic latent images have been recorded on each photoconductor drum 38, the intermediate transfer belt 18 is advanced toward each of four xerographic stations indicated by reference numerals 68, 70, 72 and 74. The full color image is assembled on the intermediate transfer belt 18 in four first transfer steps, one for each of the primary toner colors. Xerographic stations 68,70,72,74 respectively, apply toner particles of a specific color on the photoconductive surface 64 of each photoconductor drum 38.

Referring to FIG. 2, as the intermediate transfer belt 18 passes by each xerographic station 68,70,72,74, the respective photoconductor drum 38 rotates with the movement of the intermediate transfer belt 18 to synchronize the movement of the toner image 14 laid down on the intermediate transfer belt 18 by the previous xerographic station(s) 68,70, 72, with the rotation of the toner 252 on each photoconductor drum 38. Each developed image 252 recorded on each of the photoconductive surfaces 64 of each photoconductor drum 38 is transferred, in superimposed registration with one another, to the intermediate transfer belt 18 for forming the multi-color copy 14 of the colored original document.

Continuing with FIG. 2, the convergence of the biased transfer roll 12 and each photoconductor drum 38 form the nip 232 in which the toner particles 252 from the photoconductor surface 64 and the intermediate transfer belt 18 enter synchronously. The biased transfer roll 12 causes the toner image 252 on the photoconductor drum 38 to transfer to the intermediate transfer belt 18, and merge with any toner particles 14 previously transferred to the intermediate transfer- belt 18. As the transfer begins, the surface 64 of the photoconductor drum 38, the intermediate transfer belt 18, and any toner 14, 252 present on either, enter the air gaps 230.

Referring to FIG. 1, after development, the toner image 14 is moved to a transfer station 78 which defines the position at which the toner image 14 is transferred to a sheet of support material 16, which may be a sheet of plain paper or any other suitable support substrate. A sheet transport apparatus 80 moves the sheet 16 into contact with intermediate transfer belt 18. During sheet transport, the sheet 16 is moved into contact with the intermediate transfer belt 20, in synchronism with the toner image 14 developed thereon.

As shown in FIG. 1, the toner image 14 on the intermediate transfer belt 18 is transferred, in superimposed registration with one another, to the sheet for forming the multi-color copy of the colored original document. The backup roll 40 together with a biased transfer roll 82 transfer the toner image 14 to the sheet-type substrate 16. High voltage is applied to the surface of the backup roller 40 using a steel roller. The biased transfer roll 82 shaft is grounded. This creates an electric field that pulls the toner 14 from the intermediate transfer belt 18 to the substrate 16.

The sheet transport system 80 directs the sheet for transport to a fusing station and removal to a catch tray. Each photoconductor drum 38 also includes a cleaning station including a pre-clean subsystem 48, and a clean subsystem 49 for removing residual toner. An erase lamp subsystem 50 removes residual charge.

The foregoing description should be sufficient for purposes of the present application for patent to illustrate the general operation of a xerographic printer 10 incorporating the features of the present invention. As described, a xerographic printer 10 may take the form of any of several well-known devices or systems.. Variations of specific xerographic processing subsystems 22 or processes may be expected without affecting the operation of the present invention.

Referring to FIGS. 1 and 2, an embodiment of the present invention using the biased transfer roll 12 as a sensor indicates that the voltage ($V_{BTR}$) applied to the biased transfer roll 12 in order to maintain a constant current mode depends upon the electrical characteristics of components 36 which enter the nip region 232. For example, the voltage can vary depending upon the surface charge density on the photoreceptor drum 38 and the charge and dielectric thickness of the toner layers 14 on either the photoreceptor drum 38 or the intermediate transfer belt 18. The voltage applied to the shaft 228 of the biased transfer roll 12 can be monitored to determine the photoreceptor patch surface charge level 64, which is a toner-less section of photoreceptor drum 38, and/or the properties of the toner 246, such as charge density (tribo) and dielectric thickness.

Continuing with FIGS. 1 and 2, in a typical transfer step, toner 246 from both the photoconductor drum 38 (OPC) and the intermediate transfer belt (ITB) 18 may enter the nip 232. Since the biased transfer roll 12 is operated in constant current mode, the voltage applied to the shaft (VBTR) changes in response to: (1) the surface charge/potential level of the photoconductor drum 38, (2) the volume charge density (related to the tribo, Q/M) and dielectric thickness of the toner 252 on the photoreceptor drum 38, and (3) the charge density and dielectric thickness of the toner 14 on the intermediate transfer belt 18.

Referring to FIGS. 1, 1A and 2, when the intermediate transfer belt 18 and photoconductor drum surfaces 64 are moving into or out of the air gaps 230, the shift in $V_{BTR}$ is a direct measure of the surface potential of the photoreceptor drum 38 and/or the toner charge distribution. Therefore, in one embodiment, the biased transfer roll 12 can be used as a dynamic electrostatic voltmeter to measure system 10 and subsystem 22 performance and properties and enable closed loop control of the system 10 and subsystems 22.

For example, by measuring $V_{BTR}$ without toner 14 on either the OPC 38 or intermediate transfer belt 18, the performance of the raster output scanner 37, the charging device 60, photoconductor drum 38, the erase subsystem 50, the pre-clean subsystem 48, and the pretransfer device 51 can all be evaluated. $V_{BTR}$ will be simply related (roughly $V_{BTR} = V_{CONSTANT} + V_{OPC}$) to the OPC surface voltage $$(V_{OPC}) = \frac{\sigma_{OPC} D_{OPC}}{\varepsilon_0}$$

in this case. In this equation $\sigma_{OPC}$ is the surface charge density on the photoreceptor (OPC) 38, $D_{OPC} = d_{OPC}/k_{OPC}$ is the OPC dielectric thickness, $d_{OPC}$ is the OPC thickness and $k_{OPC}$ is the OPC dielectric constant.

By measuring $V_{BTR}$ with toner 252 on the photoconductor drum 38, development subsystem 24 performance, OPC pre-transfer device 51 performance, and/or changes in toner 252 properties can be evaluated. These can include, for example, toner pile height ($D_{TONOPC}$) and charge on the photoconductor drum 38. Furthermore, by monitoring the toner pile height ($D_{TONITB}$) and the charge established on the intermediate transfer belt 18 by previous xerographic stations 68,70,72,74, the transfer performance at these previous xerographic stations can also be evaluated.

Referring to FIGS. 1 and 2, the biased transfer roll 12 can also be used to measure changes in an electrical field of a component, such as the electrical field generated by the surface charge density on the photoconductor drum ($\sigma_{OPC}$) 38, a change in the dielectric thickness of a component 36, a charge deposited on a component 36, or the net charge of the component 36 and the charge deposited on the component 36. The biased transfer roll 12 can also be used to evaluate the charge and dielectric thickness of the toner 14, 252 on the photoreceptor drum 38 or the intermediate transfer belt 18.

In addition, the volume charge density (tribo) (Q/m ratio) of the toner 14, 252 on the photoconductor (drum) 38 or intermediate transfer belt 18 can be determined by measuring the mass/area of the toner 14, 252 on the intermediate transfer belt 18 or the photoconductor drum 38 using an Enhanced Toner Area Coverage (ETAC) (or equivalent) sensor, in addition to measuring $\Delta V_{BTR}$ with the bias transfer roll 12.

Moreover, measurements taken with the biased transfer roll 12 can be used to provide additional system 10 and subsystem 22 diagnostics, failure mode detection, and closed loop process control for xerographic printers 10. For example, in a xerographic printer 10 employing an electrostatic voltmeter, like the DocuColor™2060 xerographic printer system from Xerox Corporation, the biased transfer roll 12 could act as a backup in the event that the electrostatic voltmeter fails. This would be particularly useful in remote "sixth sense" machine diagnostics where electrostatic voltmeter repair is not possible. Furthermore, the addition of the biased transfer roll 12 as a sensor in combination with other sensors, such as an electrostatic voltmeter sensor (ESV) or an enhanced toner area coverage sensor (ETAC), can create development diagnostics and process controls that would otherwise be impossible to create.

Figure 3:
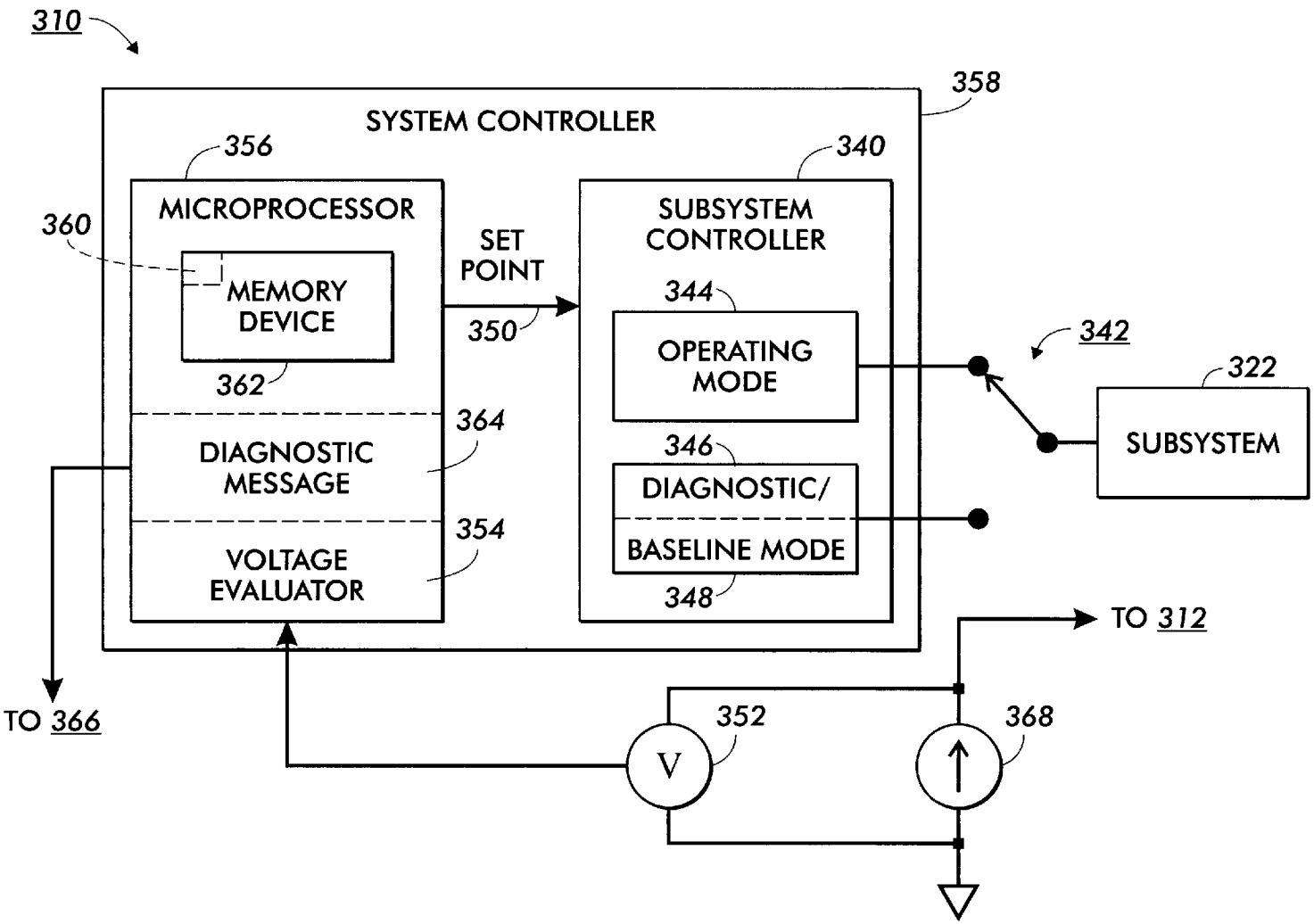
FIG. 3 is a block diagram of one embodiment of a xerographic printer illustrating measurement of components of a biased transfer roll incorporating features of the present invention.

Referring to FIG. 3, the subsystem controller 340 for a subsystem 322 can be placed in different diagnostic modes 342, such as operating 344, baseline 348 or diagnostic 346, to test any of these subsystems 322. A baseline voltage for the biased transfer roll 312 for the performance of a particular subsystem 322 can be calibrated at any time. If the xerographic printer 310 includes other sensors, such as an electrostatic voltmeter sensor, these sensors can be used to insure precise measurements in setting the baseline measurement for the biased transfer roll 312.

Referring to FIGS. 1A and 3, many subsystems 322, such as charging devices 60, a pre-clean subsystem 48, a photoreceptor charge acceptance subsystem 65, photoreceptor discharge process subsystems (Photo-Induced Discharge Curve [PIDC]; ROS 37, Erase 50), pretransfer devices 51 on the photoconductor drum (OPC) and intermediate transfer belt (ITB), toner aging, and development process subsystems 24, can have at least one predetermined set point 350. The set point 350 indicates an optimal functional setting for the subsystem 322, for example, indicating a voltage setting for a charger 60 for a photoconductor drum 38. Each subsystem 322 can also have multiple set points 350, with each set point 350 indicating the optimal setting for a different component 36 of the subsystem 322. An optimal setting may vary depending upon environmental conditions or operating effects, such as the number of sheets printed during a period of time.

Each set point 350 can be correlated to a voltage measurement of the biased transfer roll 312 while the subsystem 322 is operated in a diagnostic mode 346 or baseline mode 348. This voltage measurement of the biased transfer roll 312 is stored as a baseline measurement 360 for a system 310 or subsystem 322, or possibly for a component 36 of a subsystem 322. As the subsystem 322 functions in the operating mode 344 or in the diagnostic mode 346 the voltage of the bias transfer roll 312 is measured as the component 36 of the subsystem 322 to be evaluated is operated.

Continuing with FIG. 3, the deviation of the measured voltage from the baseline voltage measurement indicates that some desired setting, such as a desired photoreceptor voltage level or a toner depth, is not being maintained. The deviation is generally an indication that a change has occurred in the subsystem 322, or some component 36 of the subsystem 322, or that the subsystem or component is not operating properly or optimally.

If desired, the baseline setting 350 of the subsystem 322, such as the voltage level, can be adjusted by the subsystem controller 34Q to alter the setting 350, or the system controller 358 may change the calibration of the set point 350 to a new set point in order to bring the system back to an optimal or desired operational state. Alternatively, or together with the setting 350 adjustment, a diagnostic message 364 can be displayed on a xerographic printer display, such as a console 366, for evaluation by a user. Moreover, the diagnostic message 364, for example, a failure message, may be transmitted over a network 366, such as the internet, to xerographic printer service center personnel.

For measurement or diagnostic purposes, the subsystem 322 may be used without the operation of some of the other subsystems 322 in the xerographic printer 310, thereby isolating the subsystem 322 to be tested. For instance, in order to test the pre-clean subsystem 48, the erase subsystem 50 is turned off. Therefore, any changes to the voltage of the biased transfer roll 312 will be caused by the operation of the single subsystem 322 being measured. The bias transfer roll 312 voltage measurement is compared with the stored baseline measurement 360 to determine if the subsystem 322 is operating properly or optimally. If the voltage measurement taken with the bias transfer roll 312 does not equal the stored baseline measurement 360, the set point 350, of the subsystem 322 can be adjusted to a new set point 350.

The set point 350 of the subsystem 322 can be adjusted so that the voltage measurement of the bias transfer roll 312 is equal to the predetermined baseline voltage measurement of the bias transfer roll 312. The subsystem 322 can be repeatedly tested by taking further voltage measurements with the bias transfer roll 312. For each test, the set point 350 of the subsystem 322 can be readjusted, if necessary, until the voltage measurement equals the stored baseline voltage measurement.

Referring to FIGS. 2 and 3, the voltage applied to the shaft.228 of the biased transfer roll 312 to maintain a constant current is generally about 30 $\mu$A, although any amperage which allows changes in the electric field of the air gaps 230 to be monitored may be used without departing from the broader aspects of the present invention. A current regulator 368 adjusts the current to maintain a selected constant current reading.

Continuing with FIGS. 2 and 3, the voltage applied to the shaft 228 of the bias transfer roll 12 is measured by a voltmeter 352 connected to the biased transfer roll shaft 228. An output of the voltmeter 352 is connected to a voltage evaluator 354.

The voltage evaluator 354 is adapted to measure a change in a level of voltage of the bias transfer roll 12 as the component 36 affected by the subsystem 322 passes through the nip region 232 near the bias transfer roll 12 for determining operability of the subsystem 322. While a voltage evaluator 354 which is part of a microprocessor 356 has been shown, the present invention is not so limited, as any method of evaluating a change in voltage may be used without departing from the broader aspects of the present invention. The voltage evaluator is in communication with a system controller 358 of the xerographic printer 310.

As shown in FIG. 3, the system controller 358 coordinates the operation and maintenance of the xerographic printer 310 and associated subsystems 322, and monitors the biased transfer roll 312 acting as system sensors while the system 310 is in diagnostic mode 346 and in operating mode 344. The system controller 358 includes a subsystem controller 340. (one shown) for controlling each subsystem 322, such as the charging device 60, the pre-clean subsystem 48, the photoreceptor charge acceptance 65, the photoreceptor discharge process (PIDC, ROS 37, Erase 50), pretransfer devices 51 on the OPC 38 and ITB 18, toner aging, and the development process subsystems 24. While a subsystem controller 340 separate from the microprocessor 356 has been shown and described, the present invention is not so limited, as the subsystem controller 340 may be part of the microprocessor 356, or may be separate from the system controller 358, without departing from the broader aspects of the present invention.

The status, functionality and performance of each subsystem 322 can be evaluated in a diagnostic 346 or baseline mode 348 for setting a baseline voltage measurement of the bias transfer roll 312, or for generating diagnostics. Each subsystem 322 can also be evaluated with the bias transfer roll 312 while in the normal operating mode 344 for comparison with the predetermined baseline for evaluation of operational effectiveness.

Continuing to refer to FIG. 3, the microprocessor 356 associated with the system controller 358 evaluates the voltage of the biased transfer roll 312. The microprocessor 356 has the ability to alter control parameters and store the baseline voltage measurement in a memory device 362 for later comparison with a voltage measurement of the biased transfer roll 312 monitored while in operating mode 344. While a microprocessor 356 is shown as being part of the system controller 358, the microprocessor 356 can be separate from the system controller 358, such as on a separate network device. The microprocessor 356 can also be in communication with the system controller 358 over a network or internet, without departing from the broader aspects of the present invention.

Figure 4:
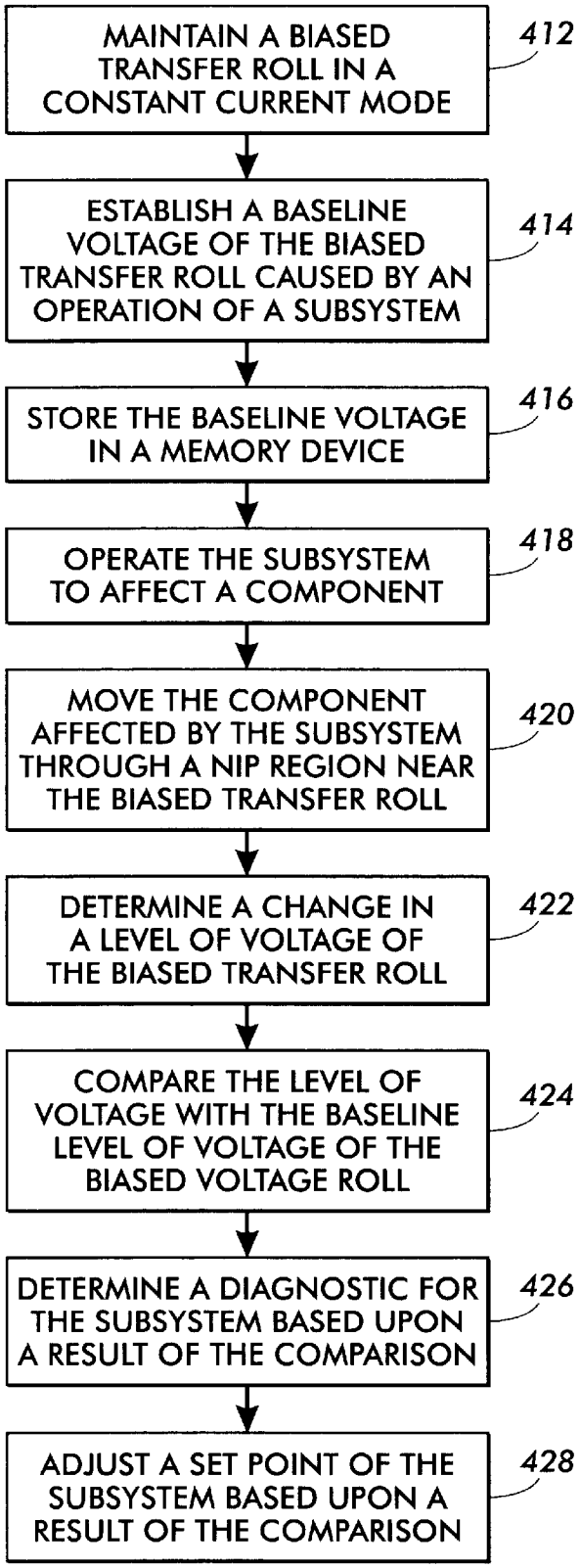
FIG. 4 is a flowchart of one embodiment of a method of the present invention illustrating the operation of the biased transfer roll incorporating features of the present invention.

The flowchart of FIG. 4 shows an embodiment of the operation of the bias transfer roll 12 as a sensor. In a step 412, a high voltage power supply 226 varies the voltage applied to the steel shaft 228 to maintain a constant current. In a step 414, a baseline voltage of the biased transfer roll 12 is established by an operation of a subsystem 22, such as one of the development subsystems 24. The baseline voltage measurement for the subsystem 22 is stored in a memory device 362, in a step 416.

Continuing with FIG. 4, in a step 418, the subsystem 22 is operated to affect a component 36 of the xerographic printer 10, such as developing a patch of toner 252 on a photoconductor drum 38. In a step 420, the component 36, such as the photoconductor drum 38, moves through the nip region 232 near the biased transfer roll 12, thereby affecting the electric field in the air gap 230. In a step 422, a change in the level of voltage of the biased transfer roll 12 caused by the movement of the component 36 through the nip region 232 is determined.

Still referring to FIG. 4, in a step 424, the level of voltage of the biased transfer roll 12 is compared with the stored baseline level of voltage of the biased transfer roll 12 that is associated with the subsystem 22 and the component 36. In a step 426, a diagnostic is determined for the subsystem 22 based on the results of the comparison, and in a step 428, the set point 350 of the subsystem 22 is adjusted, based on the results of the comparison. In addition, the method can include a step of detecting a failure mode and sending a diagnostic message 364 to either the display panel of the xerographic printer or remotely to a service center through the internet 366.

Figure 7:
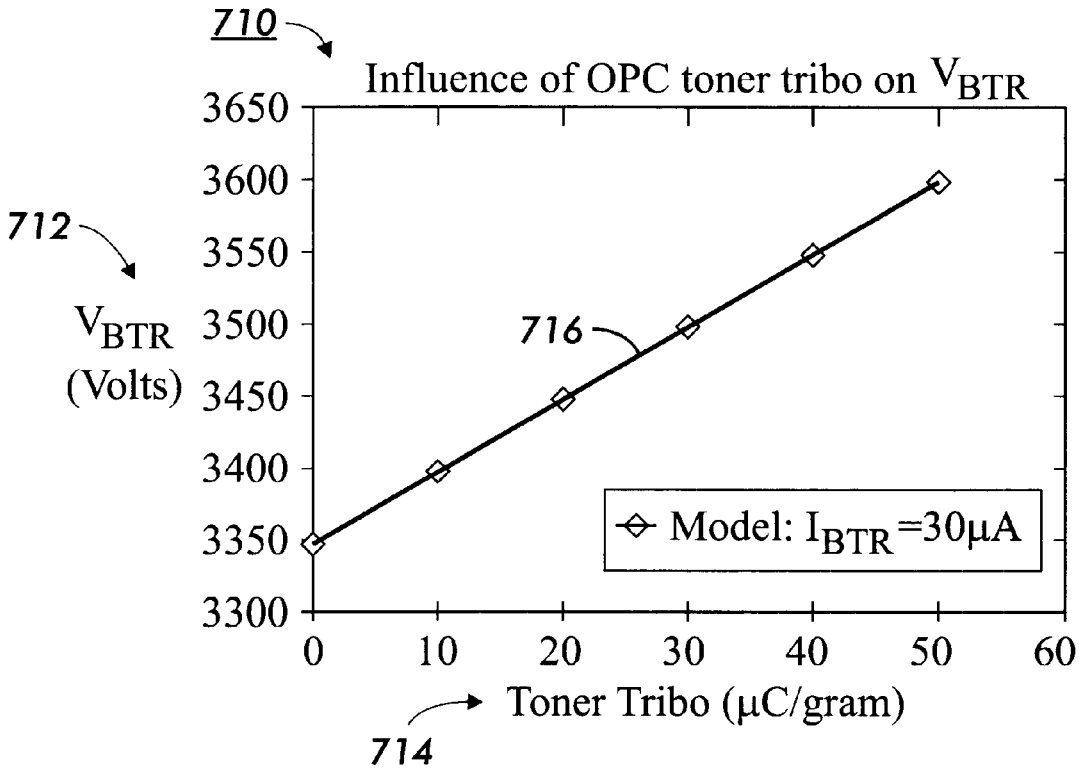
FIG. 7 is a chart showing one embodiment of the present invention illustrating a use of the biased transfer roll to measure toner tribo on a photoreceptor.

FIGS. 5, 6 and 7 show examples of the use of a biased transfer roll 12 as a dynamic electrostatic voltmeter.

FIG. 5 shows the results of the biased transfer roll 12 measuring the voltage of the photoreceptor voltage due to the surface charge density deposited by the charging device. That is, the biased transfer roll 12 measures photoconductor drum 38 charge potential and the effectiveness of a pretransfer scorotron 51 which applies additional charge to the photoconductor drum 38. The voltage of the biased transfer roll 12 (VBTR) is a function 510 of the photoconductor drum potential measured on xerographic printer 10, such as the DocuColor™2060. To isolate the effects of the pretransfer scorotron on the biased transfer roll 12, a grid voltage on a charging scorotron was varied with the development subsystems 24 turned off.

Continuing with FIG. 5, the photoconductor drum voltage ($V_{OPC}$) was measured by an electrostatic voltmeter (ESV) sensor located before the development subsystem 24 and $V_{BTR}$ was measured while the biased transfer roll 12 was operated in constant current mode ($I_{BTR}$=30 $\mu$A). As shown in FIG. 5, $V_{BTR}$ 512 decreased as the photoconductor drum 38 (OPC) potential 514 was decreased (made more negative). As expected from the analytic model, the slope of the curve 516 is approximately 1 (i.e., $\Delta V_{BTR}$ is approximately equal to $\Delta V_{OPC}$).

After "calibrating" the biased transfer roll 12 for use as a dynamic electrostatic voltmeter (see FIGS. 3 and 5), the biased transfer roll 12 was used to determine whether or not the pre-transfer device was operating properly. The pre-transfer grid voltage was set to (−600V), so the photoconductor drum 38 voltage after pre-transfer should be (−600V), independent of the photoconductor drum voltage after discharge. It was determined that the pre-transfer device only charged the photoconductor drum 38 to (−500V) after discharging to (−300V). The voltage measurement of the biased transfer roll 12 was used to demonstrate that the pretransfer scorotron had inadequate slope. This was verified by an independent measurement of the pre-transfer device, demonstrating that the biased transfer roll 12 provided accurate readings when operated as a sensor for measuring the pre-transfer device.

In another example of the use of the biased transfer roll 12 as a sensor, and referring to FIGS. 1 and 6, the biased transfer roll 12 of the fourth xerographic station 86 can be used to measure the toner pile height 14 applied to the intermediate transfer belt 18 as the toner 14 entered the nip 232 between the intermediate transfer belt 18 and the fourth xerographic station 86.

In FIG. 6, a graph 610 illustrates the sensitivity of the biased transfer roll voltage ($V_{BTR}$) at the fourth xerographic station 86 to the toner pile height 14 on the intermediate transfer belt 18. The test document contained four monochrome bars (Cyan(C), Blue(B), Process Black(PK), blank) that ran the full width of the document. The development station 24 of the fourth xerographic station 86 and the raster output scanner 37 were turned off so that these subsystems 22 would not effect the measurements of the effects of the toner pile height 14 on the biased transfer roll 88. The photoconductor drum 66 for the fourth xerographic station 86 was charged to a known value of −650 $V_{OPC,}$ which would not affect the measurements of the toner pile height 14 by the biased transfer roll 88, which is placed opposite the fourth xerographic station 86.

Continuing with FIG. 6, the biased transfer roll 88 voltage ($V_{BTR}$) 612 increased as the toner pile height 14 of the applied toner patch 614 increased from blank 616 (0 toner layers), to cyan 618 (one toner layer), to blue 620 (2 toner layers), to process black 622 (3 toner layers). In a process control application, as in this example, toner area coverage is held constant. The resulting difference in measurements for each toner patch 614 is then attributable to the differing pile height, demonstrating that the biased transfer roll 88 could provide accurate readings when operated as a sensor for measuring the toner pile height 14. It should be noted that changes in the toner volume charge density will also impact the voltage measurement of the biased transfer roll 88.

In FIG. 7, a graph 710 illustrates the sensitivity of the biased transfer roll voltage $V_{BTR}$ for measuring the toner tribo on the photoconductor drum 66. This sensitivity can be used to monitor the performance of development 24, pretransfer 51, and/or variations in toner charging 60.

FIG. 7 shows the sensitivity of the biased transfer roll voltage ($V_{BTR}$) 712 to the charge density 714 of the toner 252 developed onto the photoconductor drum (OPC) 66. In this model calculation, the toner layer 252 was assumed to be 6.8 microns thick and the toner tribo 714 was varied from 0 to 50 $\mu$C/g. The biased transfer roll voltage ($V_{BTR}$) 712 was calculated for a biased transfer roll 88 operating in constant current mode ($I_{BTR}$=30 $\mu$A). The sensitivity of the biased transfer roll voltage ($V_{BTR}$) 712 to the charge of the toner 252 applied to the photoconductor drum (OPC) 66 is given by $$\Delta V_{BTR} = \left(D_{OPC} + \frac{D_{TON}}{2}\right)\frac{d_{TON}}{\varepsilon_0}(\Delta\rho_{TON})$$

where DTON is the dielectric thickness of the toner, PTON is the volume charge density of the toner 252, and Dopc is the dielectric thickness of the photoconductor drum 66.

Referring to FIG. 7, the resulting variation 716 in the voltage of the biased transfer roll 88 is attributable to the change in toner tribo, demonstrating that the biased transfer roll 88 could provide accurate readings when operated as a sensor for measuring development 24, pretransfer, and/or variations in toner charging. In addition, shifts in the toner tribo (Q/m ratio) can be determined by measuring the mass/area using an enhanced toner area coverage (ETAC) sensor, or an equivalent sensor, in addition to measuring $\Delta V_{BTR}$.

While the fourth biased transfer roll 88 and fourth photoconductor drum 66 were shown and described for measuring toner tribo, the other biased transfer rolls could have been used without departing from the broader aspects of the present invention.

It should be understood that the foregoing description is only illustrative of the invention. Various alternatives and modifications can be devised by those skilled in the art without departing from the invention. For instance, the present invention includes an embodiment in which a biased transfer roll functions as a measuring device, and a photoreceptor with imaged toner transfers the toner from the photoreceptor to a substrate, such as paper, without transferring the toner to a transfer belt. The transfer belt is positioned underneath the substrate, between the biased transfer roll and the substrate, and passes through the nip.

As another instance, while maintaining a constant current and measuring a voltage of a biased transfer roll has been shown and described, the invention can also encompass maintaining a constant voltage and measuring a change in a level of current of the biased transfer roll. Accordingly, the present invention is intended to embrace all such alternatives, modifications and variances which fall within the scope of the appended claims.

What is claimed is:

1. A system for controlling a xerographic printer having a subsystem for carrying out a function of the xerographic printer, comprising:

a subsystem for carrying out a function of the xerographic printer and affecting an electric field generated by a component;

a bias transfer roll operated in a constant current mode;

a voltage evaluator coupled to the biased transfer roll for measuring a change in a level of voltage of the bias transfer roll as the component affected by the subsystem passes through a nip region near the bias transfer roll for determining operability of the subsystem.

2. The system of claim 1, further including a system controller for generating a baseline measurement from the measurement of the voltage of the bias transfer roll for the subsystem for determining operability of the subsystem, where the baseline measurement corresponds to a specified setting of the subsystem; and where the system controller is further adapted to compare the baseline measurement of the bias transfer roll for the subsystem with a further measurement of voltage of the bias transfer roll of the component affected by further operation of the subsystem, the comparison for comparing the setting of the subsystem relative to the specified setting of the subsystem corresponding to the baseline measurement.

3. The system of claim 2, wherein the system controller is further adapted to generate a diagnostic message based on the comparison.

4. The system of claim 2, wherein the system controller is further adapted to detect a failure mode based on the comparison.

5. The system of claim 2, wherein the system controller is further adapted for a closed loop control of the subsystem based on the comparison.

6. The system of claim 5, wherein the closed loop control includes an adjustment to the setting of the subsystem to return the voltage of the biased transfer roll to the baseline measurement.

7. The system of claim 1, wherein maintaining the bias transfer roll in constant current mode includes maintaining the bias transfer roll at 30 $\mu$A.

8. The system of claim 1, wherein the subsystem affecting the component includes at least one of a development subsystem, a photoconductor, an intermediate transfer belt, a raster output scanner, a raster input scanner, a charging device, an erase subsystem, a pretransfer device, a pre-clean subsystem, and a toner charging subsystem.

9. The system of claim 1, wherein the measurement of the change in the level of voltage of the bias transfer roll provides a measurement of an electrical field of the component, a measurement of a charge deposited on the component, a measurement of a change in a dielectric thickness of a component, or a combination thereof.

10. The system of claim 9, wherein the component being measured includes at least one of a photoconductor, an intermediate transfer belt or drum, the biased transfer roll, a back up roll, substrate, toner on the photoconductor, and toner on the intermediate transfer belt or drum.

11. A method of controlling a xerographic printer, comprising the steps of:

maintaining a biased transfer roll in a constant current mode; and measuring a change in a level of voltage of the bias transfer roll as a component affected by a subsystem carrying out a function of the xerographic printer passes through a nip region near the bias transfer roll for determining operability of the subsystem.

12. The method of claim 11, further comprising the steps of:

generating a baseline measurement from the measurement of the voltage of the bias transfer roll for the subsystem for determining operability of the subsystem, where the baseline measurement corresponds to a specified setting of a parameter of the subsystem; and comparing the baseline measurement of the bias transfer roll for the subsystem with a further measurement of voltage of the bias transfer roll of the component affected by further operation of the subsystem, the comparison for comparing the setting of the subsystem relative to the specified setting of the parameter of the subsystem corresponding to the baseline measurement.

13. The method of claim 12, wherein the step of comparing the baseline measurement with the further measurement is for generating a diagnostic for the subsystem.

14. The method of claim 13, wherein the step of generating the diagnostic for the subsystem includes the step of generating a diagnostic message for displaying on a display of the xerographic printer and/or generating a diagnostic message for displaying at a remote location via a computer network.

15. The method of claim 12, wherein the step of comparing the baseline measurement with the further measurement is for closed loop control of the subsystem.

16. The method of claim 11, wherein the step of operating the bias transfer roll in constant current mode includes maintaining the bias transfer roll at 30 $\mu$A.

17. The method of claim 11, wherein in the step of measuring the subsystem, the subsystem includes a t least one of a development subsystem, a photoconductor, an intermediate transfer belt, a raster output scanner, a raster input scanner, a charging device, an erase subsystem, a pretransfer device, and a pre-clean subsystem.

18. The method of claim 11, wherein the step of measuring of the change in the level of voltage of the bias transfer roll provides a measurement of an electrical field of the component, a measurement of a charge deposited on the component, a measurement of a change in a dielectric thickness of a component, or a combination thereof.

19. The method of claim 18, wherein in the step of measuring the electrical field of the component, the component includes at least one of a photoconductor, an intermediate transfer belt or drum, the biased transfer roll, a back up roll, substrate, toner on the photoconductor, and toner on the intermediate transfer belt or drum.

20. A method of controlling a xerographic printer, comprising the steps of:

maintaining a biased transfer roll in a constant voltage mode; and measuring a change in a level of current applied to the bias transfer roll as a component affected by a subsystem carrying out a function of the xerographic printer passes through a nip region near the bias transfer roll for determining operability of the subsystem.

* * * * *